United States Patent [19]

Meissner et al.

[11] Patent Number: 4,656,822

[45] Date of Patent: Apr. 14, 1987

[54] SPINNING MACHINE WITH SLIVER-FEED INTERRUPTER

[75] Inventors: Werner Meissner, Hattenhofen; Richard Schöllhammer, Göppingen, both of Fed. Rep. of Germany

[73] Assignee: Zinser Textilmaschinen GmbH, Ebersbach, Fed. Rep. of Germany

[21] Appl. No.: 889,333

[22] Filed: Jul. 23, 1986

[30] Foreign Application Priority Data

Jul. 23, 1985 [DE] Fed. Rep. of Germany ..... 3526305

[51] Int. Cl.[4] ..... D01H 13/18; D01H 13/14

[52] U.S. Cl. ..... 57/81; 57/78; 57/264

[58] Field of Search ..... 57/78, 80, 81, 83, 87, 57/264

[56] References Cited

U.S. PATENT DOCUMENTS

| | | | |
|---|---|---|---|
| 3,114,233 | 12/1963 | Guri | 57/81 |
| 3,430,426 | 3/1969 | Bryan | 57/81 X |
| 3,541,774 | 11/1970 | Sterba et al. | 57/78 X |
| 3,678,673 | 7/1972 | Prochazka et al. | 57/78 X |
| 3,882,663 | 5/1975 | Soukup et al. | 57/78 X |
| 4,136,511 | 1/1979 | Raasch | 57/81 X |
| 4,420,697 | 12/1983 | Fiedler et al. | 57/81 X |
| 4,484,376 | 11/1984 | Glock | 57/86 X |
| 4,512,028 | 4/1985 | Stutz | 57/264 X |

*Primary Examiner*—Donald Watkins

*Attorney, Agent, or Firm*—Karl F. Ross; Herbert Dubno

[57] ABSTRACT

A spinning machine for the production of yarn in which at each spinning station, a yarn break sensor is provided in conjunction with a sliver-stopping unit. The latter is electrically actuated and to reduce peak current draw upon simultaneous thread breaks, a time-delay circuit, e.g. using shift registers, is provided to time-stagger the operation of the stopping units.

13 Claims, 7 Drawing Figures

SPINNING MACHINE WITH SLIVER-FEED INTERRUPTER

FIELD OF THE INVENTION

Our present invention relates to a spinning machine, and more particularly, to a spinning machine having a multiplicity of spinning stations each of which is provided with a yarn-breakage sensor and with a sliver-feed-stopping element intended to respond to that sensor for interrupting sliver feed in the event of the detection of a yarn break.

BACKGROUND OF THE INVENTION

Spinning machines of this type can include, inter alia, ring-spinning machines, open-end (OE) spinning machines and bell-cup spinning machines. Such spinning machines can have a large number of spinning locations or stations and, as a rule, several hundred spinning stations and even in cases of a thousand spinning stations. Each such spinning station can be provided with a spindle or other means for taking up a spinning bobbin or spool and for driving the spinning means at this station to impart a twist of the sliver which is fed through a drafting frame and between the drafting rollers thereof to the spinning location so that the sliver is twisted to form the yarn.

The sliver-feed-stopping unit which may be provided for each such station, generally in the form of a clamp engageable with the sliver upstream or at least some of the drafting rollers of the drafting frame serve, in the case of a thread break, to prevent further intake of the sliver at the respective station thereby interrupting sliver feed until the defect is corrected. This eliminates unnecessary consumption of the sliver and prevents sliver which is fed undesirably and under conditions in which it cannot be spun into yarn, from detrimentally affecting the moving parts of the spinning station and creating a situation requiring clearing of the sliver fibers.

When there is a yarn break, moreover, continued feed of the sliver through a drafting frame may cause the sliver which continues to be fed uncontrollably to wind up on an upper or lower drafting roller so that the drafting frame can be detrimentally affected.

In OE spinning machines, in addition, the uncontrolled feed of the sliver following a unit break can plug the spinning unit at the spinning station.

As a consequence, a variety of yarn feed interrupters have been provided heretofore and in general such devices have been electrically operated, i.e. tripped by an electric current pulse. The current pulse energizes a solenoid or magnet coil which can release or actuate a mechanical device for preventing further in-feed of the sliver at each location suffering a yarn break.

A simple sliver-feed interrupter can be a normally open clamping device which has an element provided for each station so that the element is released upon detection of a yarn break at each station to clamp off further advance of the sliver.

Each clamping element is associated with an electromagnet which can displace a member retaining the clamping element in its open position when the coil of that device receives a current pulse, the element moving into its closed position.

When the yarn break is cured by the operator or by the automatic yard-tying carriage, the drafting frame is again closed and/or the clamping device reopened so that the sliver or slivers will once more be fed to the respective spinning stations and will be drawn and spun.

Each electrically actuatable sliver-stopping-device requires for its respective actuation, the electrical energy for a brief time. This energy consumption is in the form of a current pulse which has a duration of, for example, 10 to 20 milliseconds.

Thread breakages arises relatively seldomly and are distributed statistically over the spinning frame. In normal operations of a spinning machine, it is not a problem to have available sufficient electrical energy from even a comparatively low power source for operation of the sliver-feed-stopping units which may simultaneously be actuated because of such statistically distributed yarn breakages.

However, under certain operating conditions, problems arise.

These operating conditions include restarting of a machine from standstill, operation of a part of the machine, where only some of the spinning stations are activated, and like conditions which tend to place excessive stress on the yarns and either require a large number of sliver-stopping elements to be actuated simultaneously because of the nature of the operation or because an excessively large number of yarn breakages may occur.

In these conditions and in others, several hundred sensors may detect simultaneous thread breakages and substantially simultaneously energize the respective electromagnets of the sliver-stopping units.

While these occurrences are infrequent, the times at which they recur result in an inordinately high current demand, especially if all of the sliver-feed-stopping solenoids are simultaneously actuated to create a significant problem with respect to continued operation of the spinning machine. It is therefore desirable to abate the high-peak current demand presented by such a phenomenon.

OBJECTS OF THE INVENTION

It is the principal object of the present invention to provide, in a spinning machine of the type described, conditions under which the instantaneous or peak current resulting from simultaneous operation of a plurality of sliver-feed-stopping elements can be reduced.

Another object of the invention is to provide an improved method of operating a spinning machine with this result.

Yet another object of the invention is to provide a method of and an apparatus for the spinning of sliver into yarn whereby high current draw resulting from simultaneous operation of sliver-stopping elements is precluded.

SUMMARY OF THE INVENTION

These objects and others which will become apparent hereinafter are attained, in accordance with the invention, in a spinning machine of the type described provided with means such that the triggering of the sliver-feed-stopping elements is affected, in the case of a large number of thread breaks simultaneously, only with a time delay so that actuation of the respective elements is effected in a time-staggered relationship. Time-delay means is thus provided for the actuation of these stopping elements.

The instantaneous total current amplitude resulting from simultaneous current supply to a multiplicity of stopping elements can thereby be reduced to a level not substantially higher than the level which results from the statistically occurring simultaneous thread breaks.

Because the peak current which must be supplied is thereby reduced to a very significant extent, advantages are gained where high-current or even low-current sources are provided and the current supply network for the sliver-stopping elements of the machine can have relatively small dimensions. The electrical network and harness can be simplified and reliability and safety increased.

It is especially advantageous to initiate a time-staggered triggering of the sliver-feed-stopping elements only when so many stopping elements must be energized simultaneously that the total current required for such energization exceeds a predetermined level. This means that for the normal statistically arising triggerings of these elements, no time staggering is effected and a time staggering only is provided when there is a danger that the simultaneous current demand will exceed a predetermined level.

The time-delay means can be any conventional time-delay device and, for example, each sliver-feed-stopping element can be provided with a respective time-delay unit, for example, an RC (resistance capacitance) network, a delay clock or the like. The stop elements can be divided into groups, with the several groups being time-staggered in operation but all of the elements of a given group operated simultaneously, i.e. without time-staggering. A particularly preferred circuit arrangement for the actuation of the sliver-stopping devices includes a time-delay means with various time delays and having at least one shift registering and at least one pulse generator for generating a shift-stepping pulse. A respective memory cell of the shift register can be provided and for each stopping element or an individual memory cell can control several stopping units.

To reduce the number of connecting conductors, several shift registers can be used, either in parallel operation and/or in a sequential operation.

For sequential operation one shift register or a group of shift registers can trigger the next shift register or group of shift registers in cascade, or the sequential operation of the shift registers can be effected by a master shift register for controlling the subsidiary shift register.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
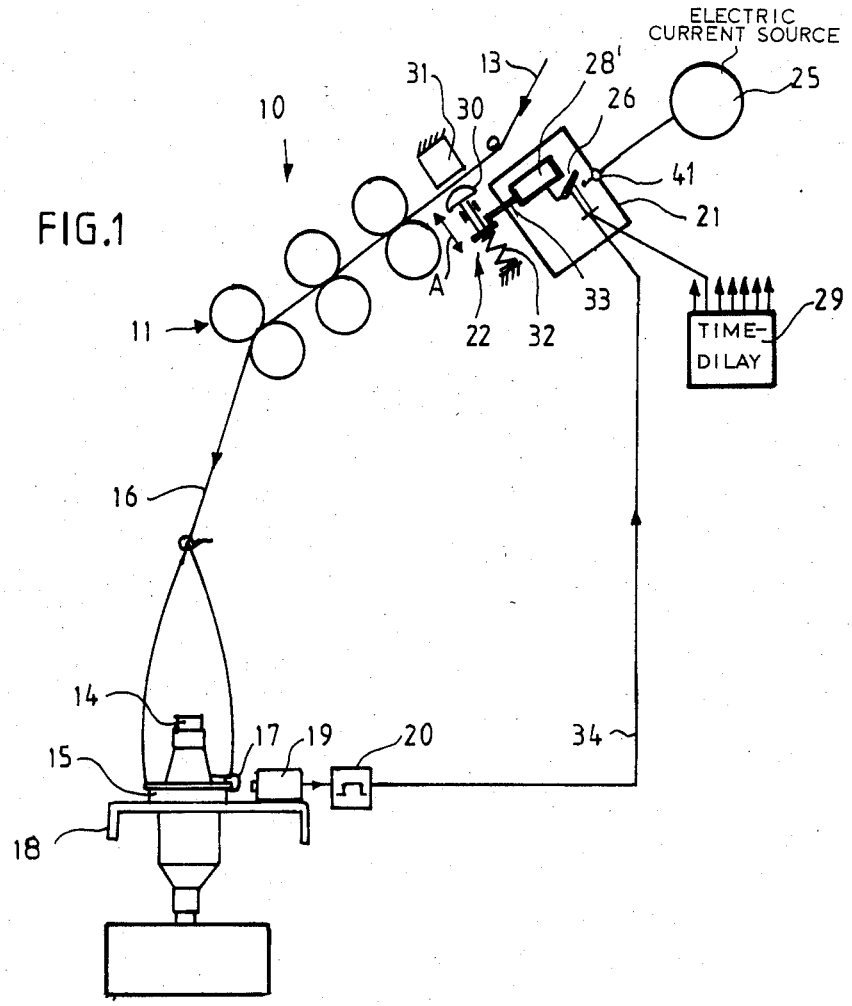
FIG. 1 is a schematic side elevational view of a single spinning station of a ring-spinning machine according to the invention and representing one of a large number of such stations on one or both longitudinal sides of the machine.

FIG. 1 shows a spinning station 10 of a spinning machine which can have hundreds to in excess of a thousand such stations, each of which includes a drafting section 11 through which the sliver with a slight twist can be passed for drawing in accordance with the usual practice. The drawn sliver passes through a yarn-guiding eye 16 and is spun by means of a spindle 14 and, in the particular case of this spinning machine, with the aid of a spinning ring upon which a traveller 17 entrained by the yarn as it is twisted, is entrained. A bobbin of the spun yarn is wound on the spindle. The bobbin core or sleeve can be doffed from the spindle in the usual manner.

The spinning rings of the respective station is carried on ring bench or platform 18 which can be raised and lowered and upon this member each spinning station can be provided with a respective yarn-break sensor 19. In the embodiment illustrated, these sensors monitor the passage of the traveller 7 inductively and, as long as there is a uniform circulation of the traveller in front of the sensor 19, the sensor considers that there is no problem requiring interruption of the sliver feed, i.e. there is no yarn breakage.

However, should the passage of the traveller 17 be delayed, the sensor determines that there has been a yarn breakage. Of course other types of spinning machines may make use of other yarn-breakage sensors and any yarn-breakage sensor conventional in the art may be used.

As long as there has been no yarn break, the sensors 19 and their signal generators 20 supply no yarn-break signal. When, however, the yarn 16 does break, the signal generator delivers for a very brief period a pulse or even a continuous signal to the control circuitry 21 of an electromagnet 28' adapted to retract a pin 33 and release the sliver-stopping element.

Each circuit 21 thus forms part of a sliver-stopping unit 22 for the respective station, the circuits 21 of all or groups of these units being provided with a time-delay circuit as represented at 29.

Consequently, each spinning station 10 is provided with a respective yarn-break sensor 19, a signal generator 20 outputting a signal which serves to interrupt sliver feed, and the aforementioned sliver-stopping unit 22 with its control circuit 21. When a thousand stations 10 are provided in a given spinning machine, a thousand each of the components 19, 20, 21 and 22 and time-delay means 29 can be provided for each of the stations or for groups of stations which can have their stopping units simultaneously operated without difficulty. Each unit can be provided with a respective time-delay circuit or a given time-delay circuit can be provided for a number of units, a minimum number of units operating by a time-delay circuit being one.

The units 22 each comprise an element 30 movable upwardly and downwardly along an inclined path as represented by the double-headed arrow A and adapted to clamp the respective sliver against a stationary anvil 31 disposed between the drafting frame 11 and a supply can or spool for the sliver 13.

A coil spring 32 biases member 30 into its clamping position and a detent formed by the pin 33 normally holds the member 30 in its open position against the force of spring 32. When the electromagnet or coil 28' is energized, it retracts the pin to release the detent and permit the spring to press the sliver against the anvil.

The output of the signal generator 20 is connected by a conductor 34 to the electronic or electromagnetic switch 26 of the circuit 21 to close the latter in response to a yarn-break signal when the time-delay circuit 29 simultaneously provides an output to the circuit 21. As can be seen from FIG. 2, this is ensured by an AND-gate 40, one of whose inputs is connected to the time-delay circuit 29 whereas the other input derives from the signal generator 20.

The output of the AND-gate 40 controls the electronic switch 26 which has an input current terminal 41 connected to a current source 25 (FIG. 1), to connect this source to the electromagnet 28'. The source 25 may be an AC source or a DC source, on the spinning machine or removed therefrom.

Figure 2:
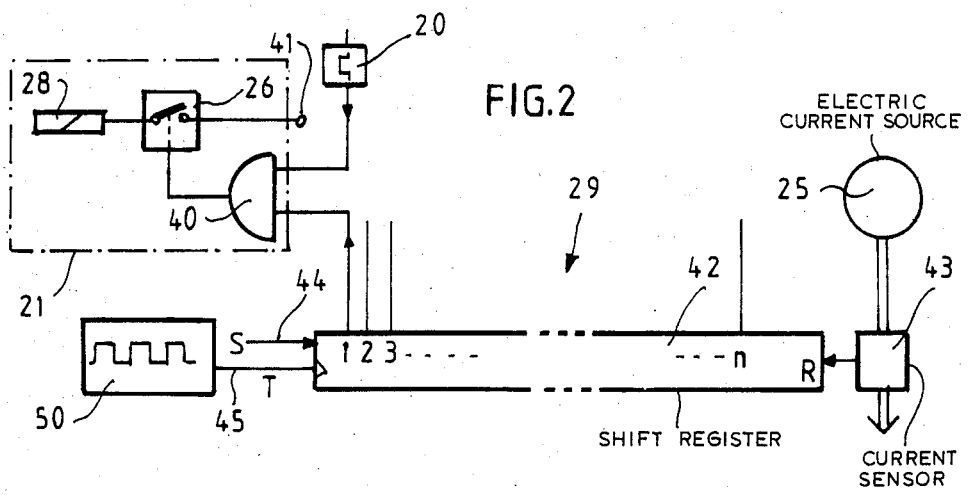
FIGS. 2–7 are respective circuit diagrams showing the time-delay circuitry for the sliver-stopping devices of the machine.

As can be seen from FIG. 2, the time-delay circuit 29 is formed as a shift register 42 which has m storage or memory cells and correspondingly n outputs where n corresponds to the number of sliver-stopping units 22 or circuits 21 controlled by the shift register.

When the machine has a large number of spinning stations and hence a very large number of sliver-stopping units, a number of commercially available shift registers can be connected serially in cascade to provide the requested number of outputs. To simplify the illustration, only the connection between the No. 1 output of the shift register 32 with its circuit 21 has been illustrated. The remaining outputs are connected to correspond to circuits 21 of the other sliver-stopping unit 22 of the spinning machine.

When there is no severe condition requiring the time delay, all of the outputs of the shift register have potentials or L-signals which gate the respective outputs from the signal generators 20 directly through for operation of the respective sliver-stopping elements without time delay. Under these circumstances the thread breaks which statistically occur and may or may not overlap to a limited extent, seldom result in a critical current draw and indeed generally 4 to 10 thread breaks can occur simultaneously without any difficulty. The current drawn from the source 25 can then be 5 to 10 times the current draw for a single sliver-stopping unit.

According to the invention, however, a current-level sensor 43 is provided in circuit with the source 25 and can respond, for example, when more than 3 thread breaks occur simultaneously or even on a threshold equivalent to a far larger number if the circuit arrangement can withstand the additional draw, to trigger the shift register 42 at its reset input R to establish that all of the outputs of the shift register, an O signal blocking the respective gates, until with a time delay determined by the stepping of the shift register, each output is brought to the level L again at a clock frequency T determined by the pulse generator 50 which acts to deliver the stepping pulses to the shift register.

A status signal S corresponding to the L signal is continuously impressed on the status-input terminal 44 of the shift register. The time delay for a given sliver-stop unit will depend, of course, on the delay time built into the delay line formed by the shift register since the outputs 1 . . . n are supplied with the gating potentials in succession and with an interval between them equal to the time constant of the shift register. The L signal can have a value "1".

As each "1" signal develops at the respective output of the corresponding shift register cell, the respective AND-gate 40 is enabled and should there be a signal at this AND-gate from the respective signal generator, the output of the AND-gate will trigger the respective electromagnet 28 or 28' for its switch 26.

If it is assumed that each shift register will thereby deliver enabling signals in succession to 10 stopping units, only one-tenth the maximum current draw will be experienced even if all these units require operation of the respective sliver-stopping elements.

Of course each shift-register cell can operate a number of such units in parallel corresponding to the maximum permissible current draw.

If the clocking frequency T is low, it is possible that only a single sliver-stopping unit will be operated at each instant. However with increasing frequency T, it is impossible that there will be overlap in operation or a greater number of units energized simultaneously and the current source 25 should be diminished accordingly.

Alternately the shift register 42 can operate in the so-called ignition distributor mode. Here the status signal S is varied to modify the L signal in the cadence of the clock signal from output to output so that all remaining outputs have an O signal. In this case, the clock frequency can be held so low that the current drain from the source 25 is at a maximum until the current required for a single stop unit. At higher frequencies each switch 26 can be held closed for a sufficient period and is then reopened.

The current-monitoring unit 43 can be eliminated when the shift register 42 continues to operate cyclically in the ignition distributor mode in a uninterrupted manner. These various possibilities can be employed also with the embodiments described below so that repetition as to how the shift register can be used alone or in combination with others to achieve various modes of time-delayed operation of the sliver-clamping elements need not be described.

Furthermore, while the use of the current detector or an equivalent for bringing into play the time-delay units when a potential excessive current drain may arise is preferred its use or omission are possible with each of the embodiments described and hence need not be separately discussed.

Figure 3:
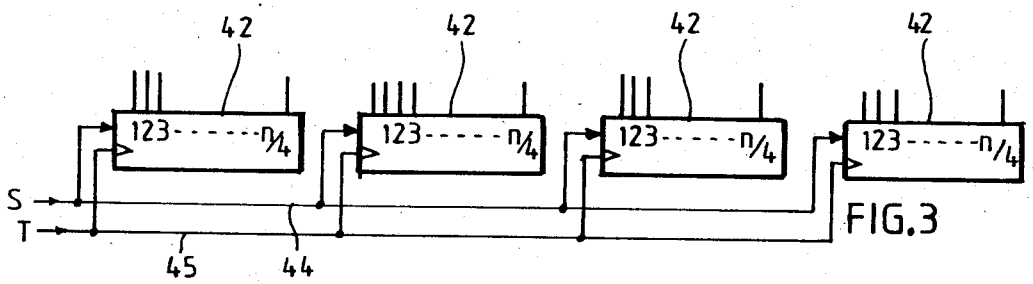

FIG. 3 shows four shift registers 42 connected in parallel, i.e. the status bus 44 is connected with the status inputs of all of the shift registers while the clock bus 45 is connected with the clock inputs of all of the shift registers. In this embodiment, with each step of the parallel shift registers, four stop units 22 can be simultaneously enabled so that the switching time over the entire assembly of stop units can be reduced to one-quarter of each of the four shift registers need have only n/4 outputs.

Since the four shift registers can be located at four different positions along the row or rows of stop units, the number of conductors and corresponding conductor lengths can be reduced. Of course the number of parallel-connected shift registers can also deviate from four, i.e. can be greater or less, the number depending upon the peak current load which is tolerable and the number of sliver-stop units which can be operated by this mechanism permissible peak current without overlapping.

Figure 4:
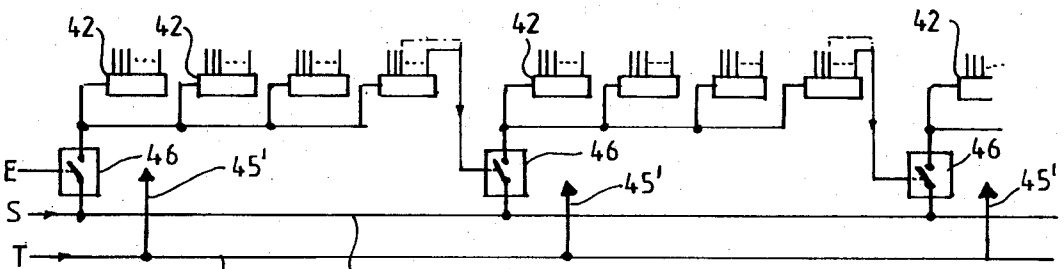

The embodiment shown in FIG. 4 comprises a plurality of groups, each of four shift registers 42. Of course the number of such shift registers can deviate from four. The status bus 44 is connected to the inputs of the respective shift registers via electronic switches 46, the first of which is triggered by an input signal E while the others are triggered from the preceding group of shift registers.

The clock bus 45 is connected in parallel to all of the shift registers as represented by the arrows 45' used to avoid excessive conductors which may obscure the circuit.

The signal E can be generated by a current-monitor circuit 43 or, when a simple cycling system is used, the output from the last shift register of the last group, or the last cell of a shift register of one of the groups when, as shown, the shift registers of each group are connected in parallel.

If overlap is to be permitted, the trigger signals for the next group can be branched from an earlier storage cell as shown in dot-dash lines.

In this embodiment the total switching time across the outputs of the shift register can be reduced to one-quarter of the time for switching through the shift register in the first embodiment and to the extent overlap of simultaneous actuations of the sliver-stopping mechanism may be permitted, still further reductions may be made.

The number of outputs per shift register in this embodiment is reduced still further by comparison with the embodiment of FIG. 3 as a result of the grouping of the shift registers. The wiring harnesses are also reduced in complexity by comparison with the latter embodiment.

Figure 5:
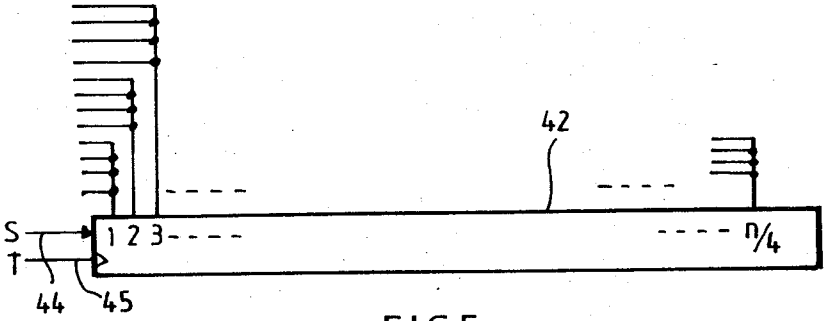

In the embodiment of FIG. 5, each shift register output is connected in parallel to four sliver-stopping units, again reducing the total number of outputs required by the shift register by the factor of the number of stopping units connected to each output.

The switching time is likewise reduced by a factor of 1/m where m is the number of circuits 21 connected to each shift register output.

Figure 6:
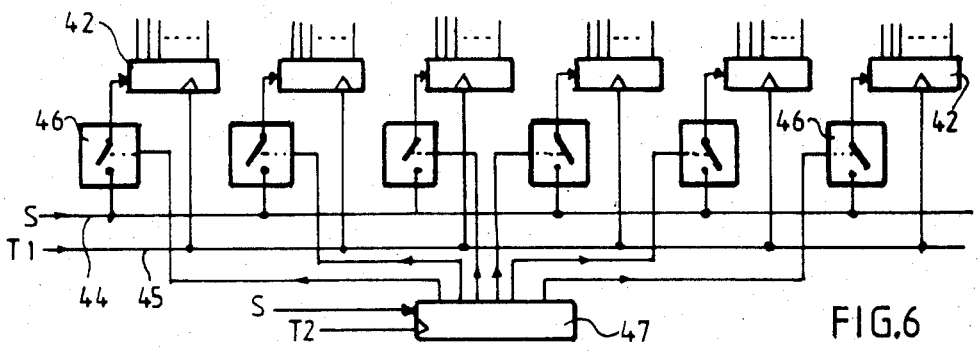

In the embodiment of FIG. 6, each of the shift registers 42 is connected to the status line 44 by a respective electronic switch 46 operated from the six outputs, for example of a command shift register 47. The shift registers 42 are stepped as previously described with a clock frequency T1 while the shift register 47 receives a statistic signal S and another clock frequency T2 which is lower than the clock frequency T1.

In this embodiment, the shift registers 42 are enabled one after another, in accordance with the reduced clock frequency T2. By selecting the clock frequencies and the number of outputs per shift register, a certain number of sliver-stopping units can be operated simultaneously and hence this number is selected to be, for example, four, or a number which will not provide an excessive peak current.

During starting of the machine when numerous thread breaks may be expected, the clock frequencies can be adjusted to reduce the overlapping or eliminate it entirely.

After startup and several cycles of the shift registers, the clock frequency T2 can be increased to allow significantly more overlapping, thereby reducing the delay time for operation of any of the sliver-stopping units to an extremely small value. This latter mode of operation, of course, can coincide with a purely statistical occurrence of thread breaks.

The system can be operated cyclically in the manner of an ignition distributor and here again there is a reduction in the number of outputs per shift register and to the extent that the number of outputs can be reduced, the complexity of the wiring can be reduced as well.

It can also be provided that one or more of the switches 46, after being closed at the beginning of the startup of the spinning machine, remains closed to the next shutdown of the spinning machine so that the shift register 47 becomes effective only during startup, while the ignition distributor function is effected thereafter.

Figure 7:
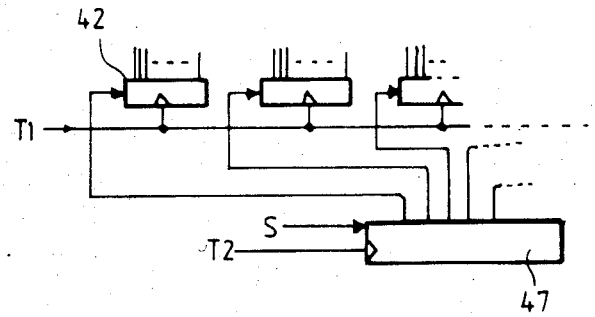

Another embodiment utilizing this principle but wherein the shift register 47 resets the shift registers 42 or enables them directly has been shown in FIG. 7. This circuit which can also operate with an ignition distributor function, can make use of commercially available shift registers with 16 outputs each.

We claim:

1. In a spinning machine having a multiplicity of spinning stations each provided with a sliver feed for a respective sliver, a spinning spindle and means for receiving said sliver for spinning said sliver into yarn on said spindle, a yarn-breakage sensor responsive to a yarn break at the respective station, and a sliver-feed-stopping element actuatable upon detection of a yarn break at the respective station by said sensor, the improvement which comprises:

means responsive to an excessive number of simultaneous thread breaks as detected by said sensors at said stations for operating all at least the respective sliver-feed-stopping elements at the stations at which thread breaks are detected; and time-delay means connected to said sliver-feed-stopping elements for time-staggering the operation of said sliver-feed-stopping elements upon said detection of said excessive number of simultaneous thread breaks.

2. The improvement defined in claim 1 wherein the time-delay means is constructed and arranged so that the delay times for all of said sliver-feed-stopping elements are different.

3. The improvement defined in claim 1 wherein the sliver-feed-stopping elements are provided in respective groups each having a plurality of said sliver-feed-stopping elements for a corresponding number of said spinning stations, said time-delay means being constructed and arranged so that the delay times for all said groups are different, but the delay times for all of the sliver-feed-stopping elements within each group are the same.

4. The improvement defined in claim 1, further comprising means for enabling said time-delay means for time-staggering the operation of said sliver-feed-stopping elements upon said detection of said excessive number of simultaneous thread breaks only when the total current required for the operation of said sliver-feed-stopping elements exceeds a predetermined value.

5. The improvement defined in claim 1 wherein said time-delay means includes at least one shift register, and at least one pulse generator for generating shift-register stepping pulses connected to said shift register.

6. The improvement defined in claim 5 wherein said time-delay means includes a single shift register for all of said sliver-feed-stopping elements and said shift register has a respective memory cell assigned to each of said sliver-feed-stopping elements.

7. The improvement defined in claim 5 wherein said time-delay means includes a plurality of shift registers connected in parallel to a common shifting-pulse generating frequency generator.

8. The improvement defined in claim 5 wherein said time-delay means includes a plurality of shift registers connected in parallel to the output of a common shift register.

9. In a method of operating a spinning machine having a multiplicity of spinning stations each provided with a sliver feed for a respective sliver, a spinning spindle and means for receiving said sliver for spinning said sliver into yarn on said spindle, a yarn-breakage sensor responsive to a yarn break at the respective station, and a sliver-feed-stopping element actuatable upon detection of a yarn break at the respective station by said sensor, the improvement which comprises:

time-staggering the operation of said sliver-feed-stopping elements upon the detection of an excessive number of simultaneous thread breaks.

10. The improvement defined in claim 9 wherein the time-staggering of the operation of said sliver-feed-stopping elements upon the detection of an excessive number of simultaneous thread breaks is effected by applying different time delays to all of the actuated sliver-feed-stopping elements.

11. The improvement defined in claim 9 wherein the time-staggering of the operation of said sliver-feed-stopping elements upon the detection of an excessive number of simultaneous thread breaks is effected by applying different time delays to each of a plurality of groups of the actuated sliver-feed-stopping elements while maintaining the same time delays among the sliver-feed-stopping elements of each of said groups.

12. The improvement defined in claim 9 wherein the time-staggering of the operation of said sliver-feed-stopping elements upon the detection of an excessive number of simultaneous thread breaks is effected only upon the total current requirement for actuating said sliver-feed-stopping elements exceeds a predetermined value.

13. In a spinning machine having a multiplicity of spinning stations each provided with a sliver feed for a respective sliver, a spinning spindle and means for receiving said sliver for spinning said sliver into yarn on said spindle, a yarn-breakage sensor responsive to a yarn break at the respective station, and a sliver-feed-stopping element actuatable upon detection of a yarn break at the respective station by said sensor, the improvement which comprises:

time-delay means connected to said sliver-feed-stopping elements for time-staggering the operation of said sliver-feed-stopping elements.

* * * * *